US008885444B2

(12) United States Patent
Mitani et al.

(10) Patent No.: US 8,885,444 B2
(45) Date of Patent: Nov. 11, 2014

(54) ANALOG ELECTRONIC WATCH

(71) Applicant: Seiko Instruments Inc., Chiba (JP)

(72) Inventors: Makoto Mitani, Chiba (JP); Kotaro Watanabe, Chiba (JP)

(73) Assignee: Seiko Instruments Inc., Chiba (JP)

( * ) Notice: Subject to any disclaimer, the term of this patent is extended or adjusted under 35 U.S.C. 154(b) by 3 days.

(21) Appl. No.: 13/785,412

(22) Filed: Mar. 5, 2013

(65) Prior Publication Data

US 2013/0250741 A1 Sep. 26, 2013

(30) Foreign Application Priority Data

Mar. 22, 2012 (JP) ..... 2012-065985

(51) Int. Cl.
*G04C 3/00* (2006.01)
*G04G 3/00* (2006.01)

(52) U.S. Cl.
CPC ..... *G04G 3/00* (2013.01)
USPC ..... 368/160

(58) Field of Classification Search
CPC ..... G04G 3/00
USPC ..... 368/160
See application file for complete search history.

(56) References Cited

U.S. PATENT DOCUMENTS

| | | | | |
|---|---|---|---|---|
| 4,817,063 | A | 3/1989 | Kawaguchi | |
| 7,606,116 | B2 * | 10/2009 | Manaka et al. | 368/157 |
| 8,064,294 | B2 * | 11/2011 | Manaka et al. | 368/157 |
| 8,139,445 | B2 * | 3/2012 | Honmura et al. | 368/157 |
| 2002/0172098 | A1 * | 11/2002 | Manaka | 368/160 |
| 2002/0186622 | A1 * | 12/2002 | Ogasawara | 368/157 |
| 2009/0274011 | A1 * | 11/2009 | Fujisawa | 368/47 |

FOREIGN PATENT DOCUMENTS

JP 63-182591 A 7/1988

* cited by examiner

*Primary Examiner* — Amy Cohen Johnson
*Assistant Examiner* — Jason Collins
(74) *Attorney, Agent, or Firm* — Brinks Gilson & Lione

(57) ABSTRACT

The analog electronic watch includes: a crystal oscillator; an oscillator circuit; a frequency divider circuit; an output control circuit; a constant voltage circuit; and a cell. The constant voltage circuit and the output control circuit are powered from the cell. The oscillator circuit and the frequency divider circuit are powered from the constant voltage circuit. The constant voltage circuit is capable of outputting a first constant voltage and a second constant voltage in a switchable manner. The second constant voltage is a voltage which is equal to or lower than a cell voltage. The first constant voltage is a voltage which is smaller than the second constant voltage. The constant voltage is switched to the second constant voltage in a period of outputting the motor drive pulse.

4 Claims, 8 Drawing Sheets

ANALOG ELECTRONIC WATCH

RELATED APPLICATIONS

This application claims priority under 35 U.S.C. §119 to Japanese Patent Application No. 2012-065985 filed on Mar. 22, 2012, the entire content of which is hereby incorporated by reference.

BACKGROUND OF THE INVENTION

1. Field of the Invention

The present invention relates to an analog electronic watch, and more particularly, to a stable operation of an oscillator circuit during motor driving.

2. Description of the Related Art

In general, an analog electronic watch using a crystal oscillator circuit for use in a wristwatch or the like includes, as illustrated in FIG. 6, a crystal oscillator 60, a semiconductor device 61, a motor 62, and a cell 63. The semiconductor device 61 includes an oscillator circuit 611 capable of oscillation at a stable frequency by a combination with the external crystal oscillator 60, a frequency divider circuit 612 for frequency-dividing a reference clock signal obtained from the oscillator circuit 611 into a clock signal of a desired frequency, a constant voltage circuit 610 for driving the oscillator circuit 611 and the frequency divider circuit 612, and an output control circuit 613 for operating the motor 62.

FIG. 7 shows waveforms at nodes of the analog electronic watch circuit during operation. FIG. 7 shows the case of a negative power supply in which VDD is a ground voltage. The cell 63 and the motor 62 have resistive components, and hence, when a motor pulse is output, a cell voltage VSS drops by a voltage ΔVSS which is determined by the product of a motor load current and a cell internal resistance. When the rotation of the motor is finished to release a motor load, the cell voltage is returned to the original voltage, but the same voltage drop occurs in the next rotation of the motor. Subsequently, the voltage drop is periodically repeated. The voltage drop ΔVSS causes a transient voltage drop ΔVREG also in an output voltage VREG of the constant voltage circuit 610 for driving the oscillator circuit 611 and the frequency divider circuit 612. In order to reduce current consumption of the oscillator circuit 611 and the frequency divider circuit 612, the output voltage VREG is set as close as possible to an oscillation stop voltage VDOS of the oscillator circuit 611. When the output voltage VREG falls below the oscillation stop voltage VDOS in absolute value due to the voltage drop ΔVREG, the oscillation becomes unstable, and at worst, the oscillation stops.

To deal with this problem, the fluctuation in cell voltage is made gentle (200 μs or more) and the ratio RL/RB between a motor equivalent resistance RL and a cell internal resistance RB is set to 2 or more. Then, as shown in FIG. 8, the fluctuation at the time of the cell voltage drop becomes gentle, thus suppressing a fluctuation amount of the output voltage VREG (see, for example, Japanese Patent Application Laid-Open No. Sho 63-182591).

However, the gentleness of the fluctuation in cell voltage is determined by a time constant of the capacitance of the cell itself and the internal resistance RB. Thus, a cell having a time constant of 200 μs or less cannot be used. Further, because the ratio RL/RB between the motor equivalent resistance RL and the cell internal resistance RB needs to be set to 2 or more, a combination of the motor and the cell to be used is limited. In addition, the above-mentioned quantitative values (200 μs and RL/RB≥2 for cell fluctuation) are based on actual measurement results, but it is considered that the above-mentioned quantitative values need to be redefined depending on the difference in design value of the oscillator circuit, the difference in semiconductor manufacturing condition, and the like. Thus, the quantitative values cannot be completely defined.

SUMMARY OF THE INVENTION

The present invention provides a crystal oscillator circuit capable of obtaining stable oscillation even if a cell voltage fluctuates when a motor load is applied, without limiting a combination of a motor and a cell to be used. The crystal oscillator circuit includes: an oscillator circuit for generating a reference clock signal; a frequency divider circuit for frequency-dividing the reference clock signal into a clock signal of an arbitrary frequency; an output control circuit for generating a motor pulse for driving an external motor by a combination with the clock signal of the arbitrary frequency; and a constant voltage circuit for outputting a constant voltage. The constant voltage circuit and the output control circuit are powered from the external cell. The oscillator circuit and the frequency divider circuit are powered from the constant voltage circuit. The constant voltage is switchable between a first constant voltage and a second constant voltage. The first constant voltage is a voltage which is smaller in absolute value than a cell voltage. The second constant voltage is a voltage which is equal to or lower than the cell voltage and larger in absolute value than the first constant voltage. The constant voltage is switched to the first constant voltage in a case of normal oscillation. The constant voltage is switched to the second constant voltage in a period from immediately before the motor pulse is output to immediately after the motor pulse is output.

According to the present invention, stable oscillation can be obtained even in the state where a motor load is applied during motor rotation, and further a combination of the cell and the motor is not limited.

DETAILED DESCRIPTION OF THE PREFERRED EMBODIMENT

Referring to the accompanying drawings, an embodiment of the present invention is described below.

Figure 1:
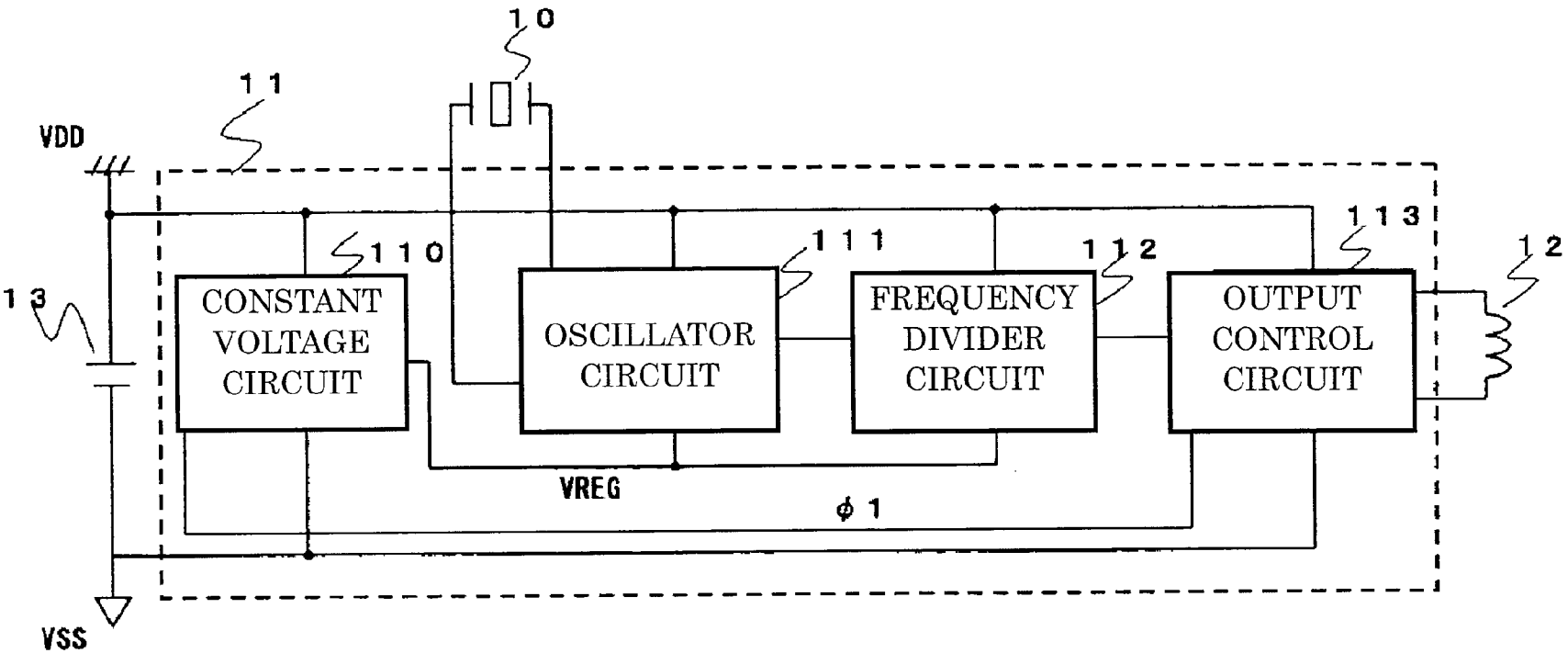
FIG. 1 is a block diagram of an analog electronic watch circuit according to the present invention.

FIG. 1 is a block diagram of an analog electronic watch circuit according to the present invention. The analog electronic watch circuit includes a crystal 10, a semiconductor device 11, a motor 12, and a cell 13. The semiconductor device 11 includes an oscillator circuit 111, a frequency divider circuit 112 for frequency-dividing a reference clock signal obtained from the oscillator circuit 111 into a clock signal of a desired frequency, a constant voltage circuit 110 for driving the oscillator circuit 111 and the frequency divider circuit 112, and an output control circuit 113 for operating the motor 12. The output control circuit 113 outputs a motor pulse for operating the motor 12. The output control circuit 113 further outputs, to the constant voltage circuit 110, a control signal $\phi 1$ for switching a voltage value of an output voltage VREG of the constant voltage circuit 110 before and after a motor pulse output period.

Figure 2:
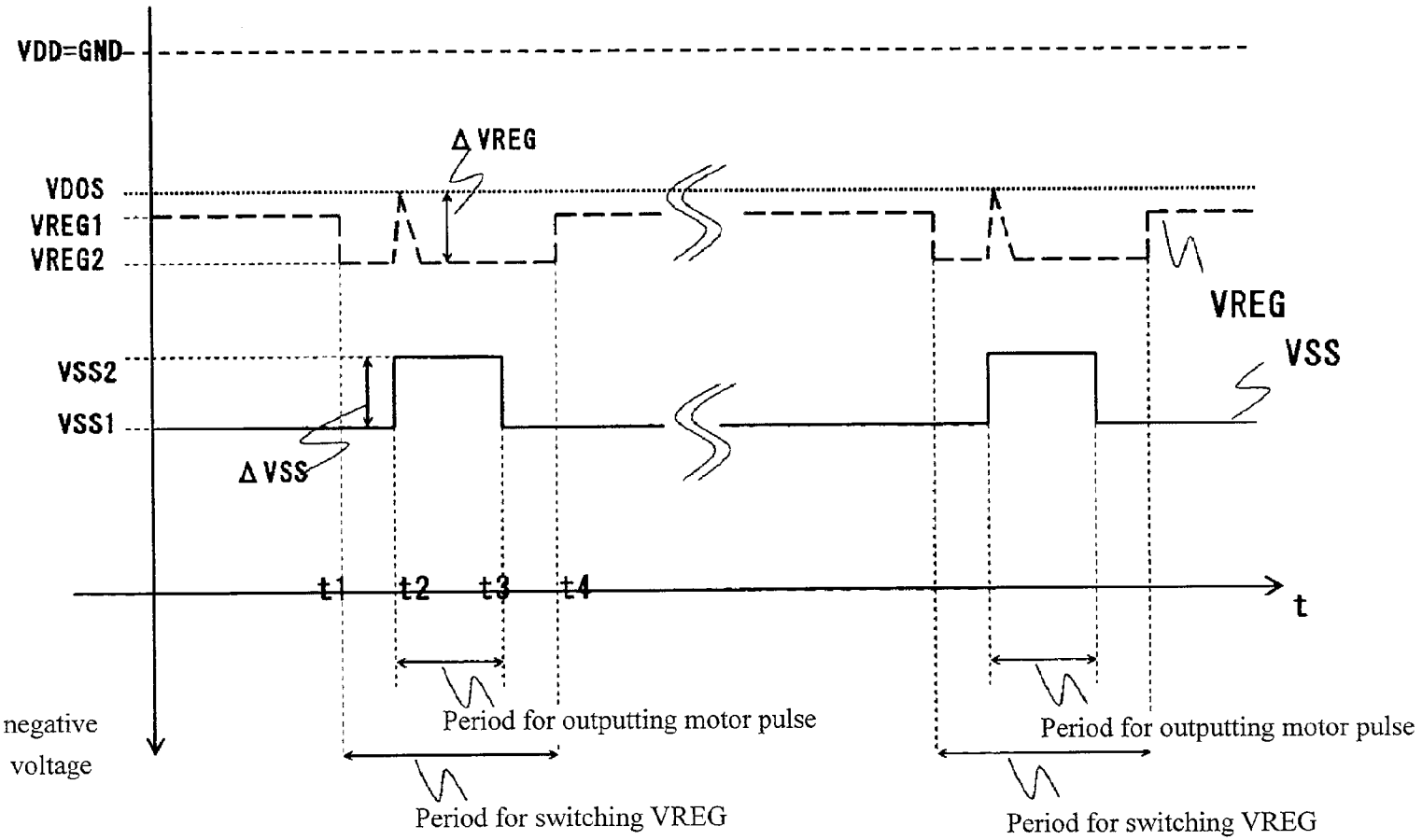
FIG. 2 is an operation explanatory diagram of the analog electronic watch circuit according to the present invention.

Next, the operation of the analog electronic watch circuit is described. FIG. 2 shows waveforms at nodes of the analog electronic watch circuit relating to the operation, showing the case of a negative power supply in which VDD is a ground voltage.

A period of time $t<t1$ is a normal operation period in which the motor is not driven and a counting operation is performed inside the analog electronic watch circuit. In this case, a cell voltage VSS is VSS1, and the output voltage VREG of the constant voltage circuit 110 is VREG1. In order to reduce current consumption of the oscillator circuit 111 and the frequency divider circuit 112, VREG1 is set to a voltage value which is slightly larger in absolute value than an oscillation stop voltage VDOS of the oscillator circuit 111 ($|VREG1|>|VDOS|$).

A period of $t1<t<t2$ is a period immediately before the motor pulse is output. At timing t1, VREG is switched to VREG2 in response to a change of the control signal $\phi 1$ from Low level to High level. VREG2 is a voltage which is larger in absolute value than VREG1 and smaller in absolute value than VSS1 ($|VSS1|>|VREG2|>|VREG1|$).

A period of $t2<t<t3$ is a period for outputting the motor pulse. When the motor pulse is output, a voltage drop $\Delta VSS$ determined by the product of a load current of the motor 12 and an internal resistance of the cell 13 occurs so that VSS drops to VSS2 ($|VSS2|=|VSS1|-|\Delta VSS|$). This steep change of VSS from VSS1 to VSS2 delays the response of the constant voltage circuit 110, and hence a voltage drop $\Delta VREG$ occurs transiently in VREG. VREG2 is set to satisfy $|VREG2|-|\Delta VRGE|>|VDOS|$, and hence the continuation of stable oscillation of the oscillator circuit 111 can be ensured even when $\Delta VREG$ is generated.

A period of $t3<t<t4$ is a period immediately after the motor pulse is output. At timing t4, VREG is switched from VREG2 to VREG1 in response to a change of the control signal $\phi 1$ from High level to Low level. In this way, the oscillator circuit 111 and the frequency divider circuit 112 operate with low consumption until the switch of the output voltage VREG following the next motor pulse output.

Subsequently, a series of the above-mentioned operation is repeated continuously at the timing of outputting the motor pulse.

In the period of $t1<t<t4$, VREG is temporarily switched from VREG1 to VREG2. As a result, in the period of $t1<t<t4$, the operating currents of the oscillator circuit 111 and the frequency divider circuit 112 are increased, and the oscillation frequency slightly changes. However, for example, the cycle of the motor pulse output is 1 s and the period for switching to VREG2 is several ms, and hence this influence is reduced to 1/100 to 1/1,000 and can almost be neglected. Although the operation has been described with reference to FIG. 2 in which the period of $t1<t<t2$ is provided, the period of $t1<t<t2$ may be omitted so that VREG is switched from VREG1 to VREG2 at timing t2. Alternatively, although the operation has been described with reference to FIG. 2 in which the period of $t3<t<t4$ is provided, the period of $t3<t<t4$ may be omitted so that VREG is switched from VREG2 to VREG1 at timing t3.

Figure 3:
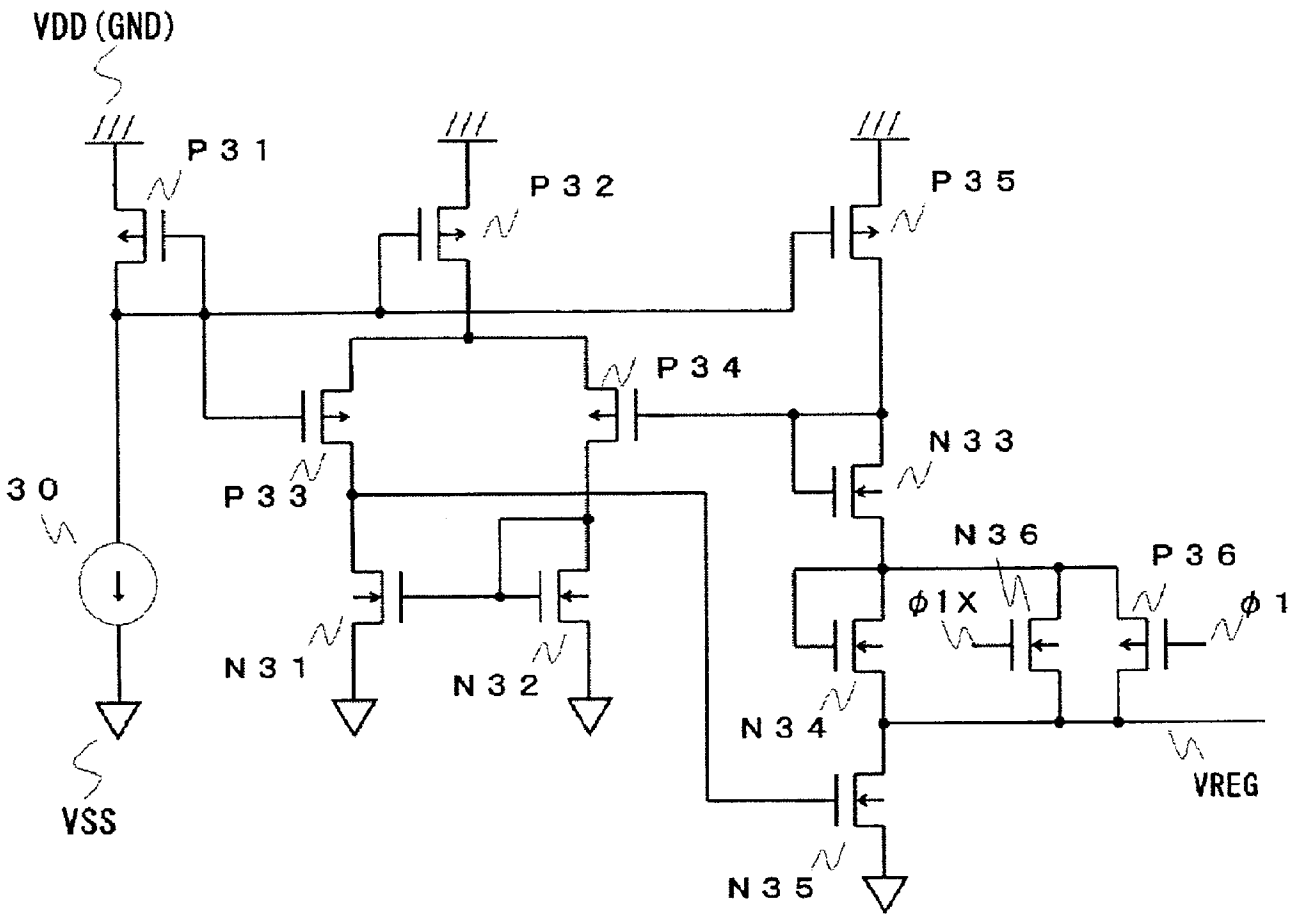
FIG. 3 is a configuration example of the constant voltage circuit according to the present invention.

FIG. 3 illustrates a configuration example of the constant voltage circuit 110 according to this embodiment. A control signal $\phi 1X$ is an inverted signal of the control signal $\phi 1$. When the control signal $\phi 1$ is Low level, a switch formed of transistors N36 and P36 is turned ON, and a transistor N34 is short-circuited. VREG becomes VREG1 which is determined by the sum of a gate-source voltage of a transistor P31 and a gate-source voltage of a transistor N33. On the other hand, when the control signal $\phi 1$ is High level, the switch formed of the transistors N36 and P36 is turned OFF, and the transistor N34 is not short-circuited. VREG becomes VREG2 which is determined by the sum of the gate-source voltage of the transistor P31, the gate-source voltage of the transistor N33, and a gate-source voltage of the transistor N34.

Note that, in the analog electronic watch, one conceivable means for oscillating and starting the oscillator circuit 111 is to apply an oscillation start voltage VBUP to the oscillator circuit 111, which is larger in absolute value than VREG for continuing oscillation at low consumption. In the case where a VBUP generation circuit is provided, VBUP may be used as VREG2. In this case, the circuit can be more simplified.

Figure 4:
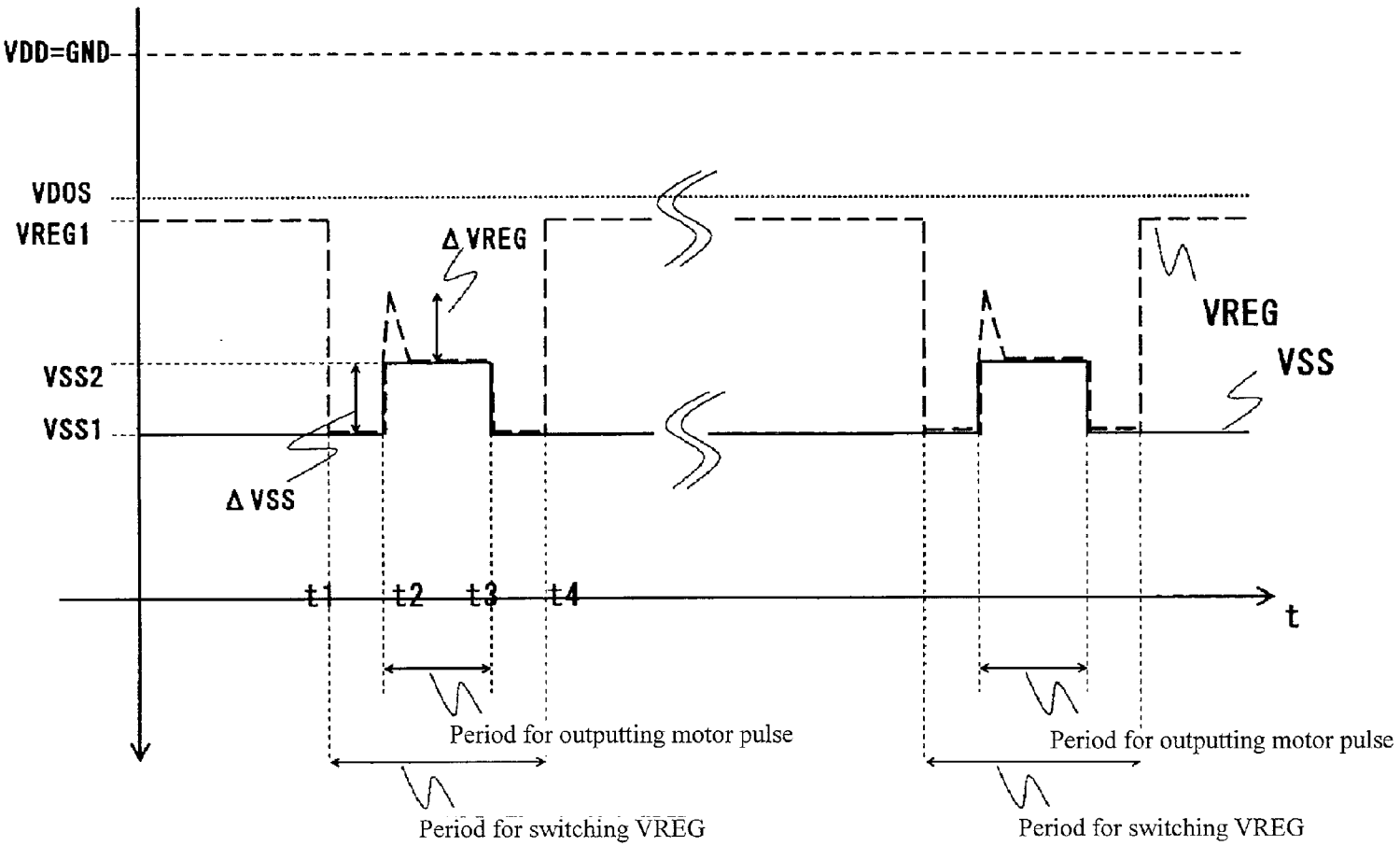
FIG. 4 is an operation explanatory diagram of the analog electronic watch circuit according to the present invention.

Further, the second output voltage VREG2 of the output voltage VREG of the constant voltage circuit 110 can be used as the VSS voltage. FIG. 4 shows waveforms at nodes relating to the operation in this case.

Figure 5:
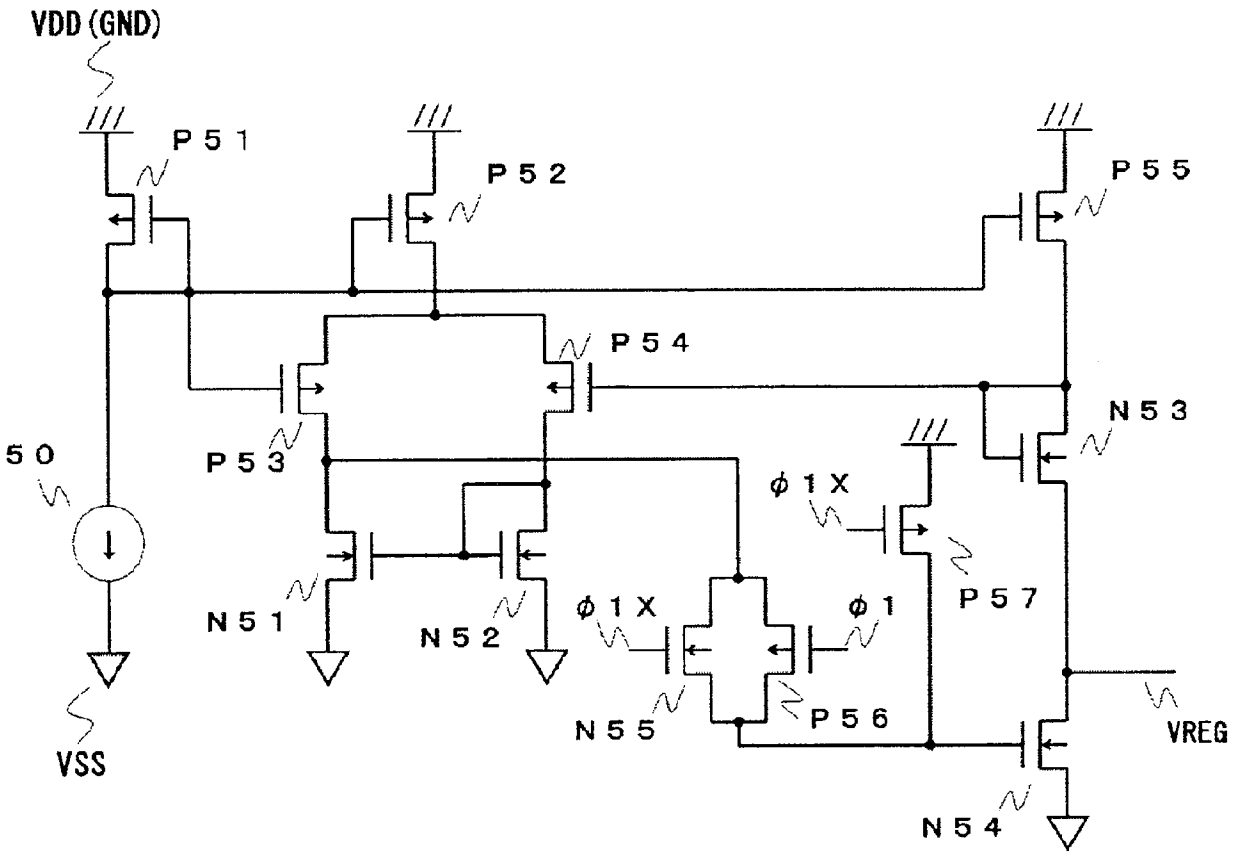
FIG. 5 is an another configuration example of the constant voltage circuit according to the present invention.
Figure 6:
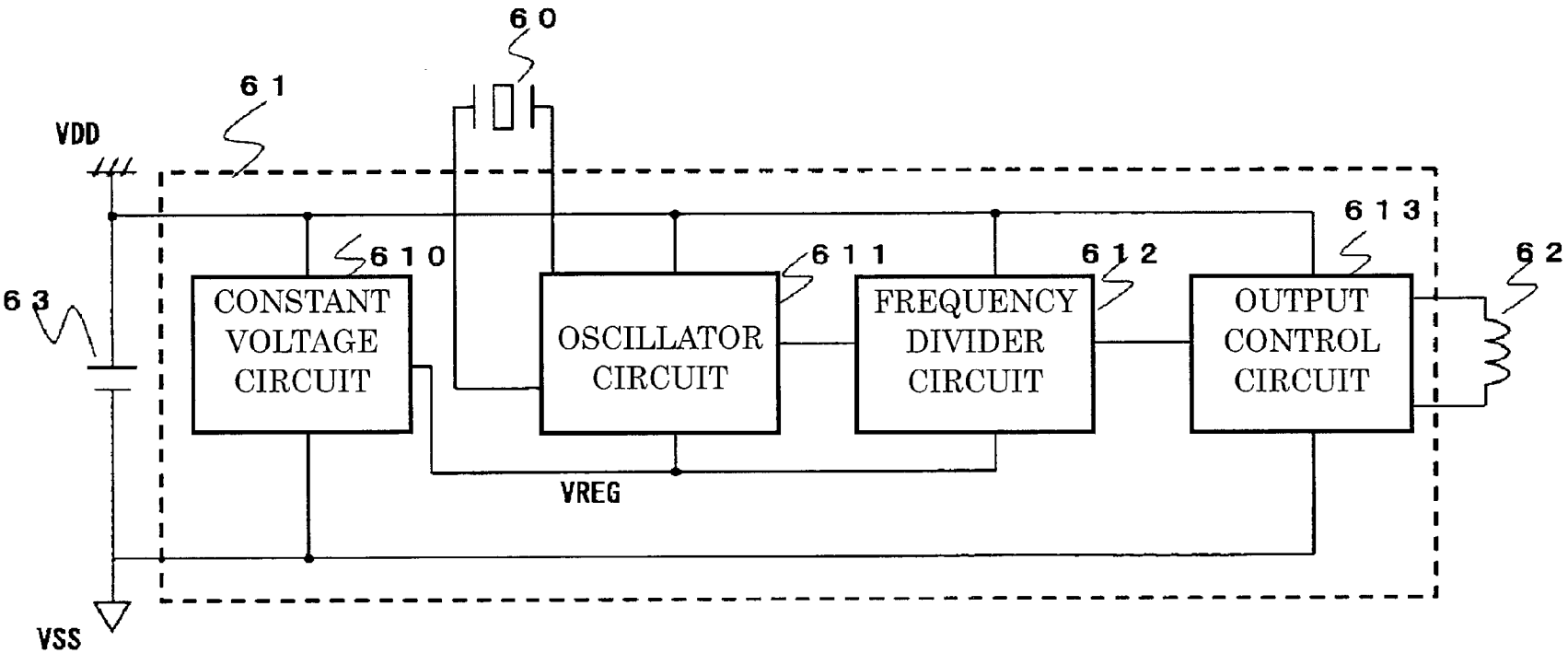
FIG. 6 PRIOR ART
FIG. 6 is a block diagram of an analog electronic watch circuit according to the conventional invention.
Figure 7:
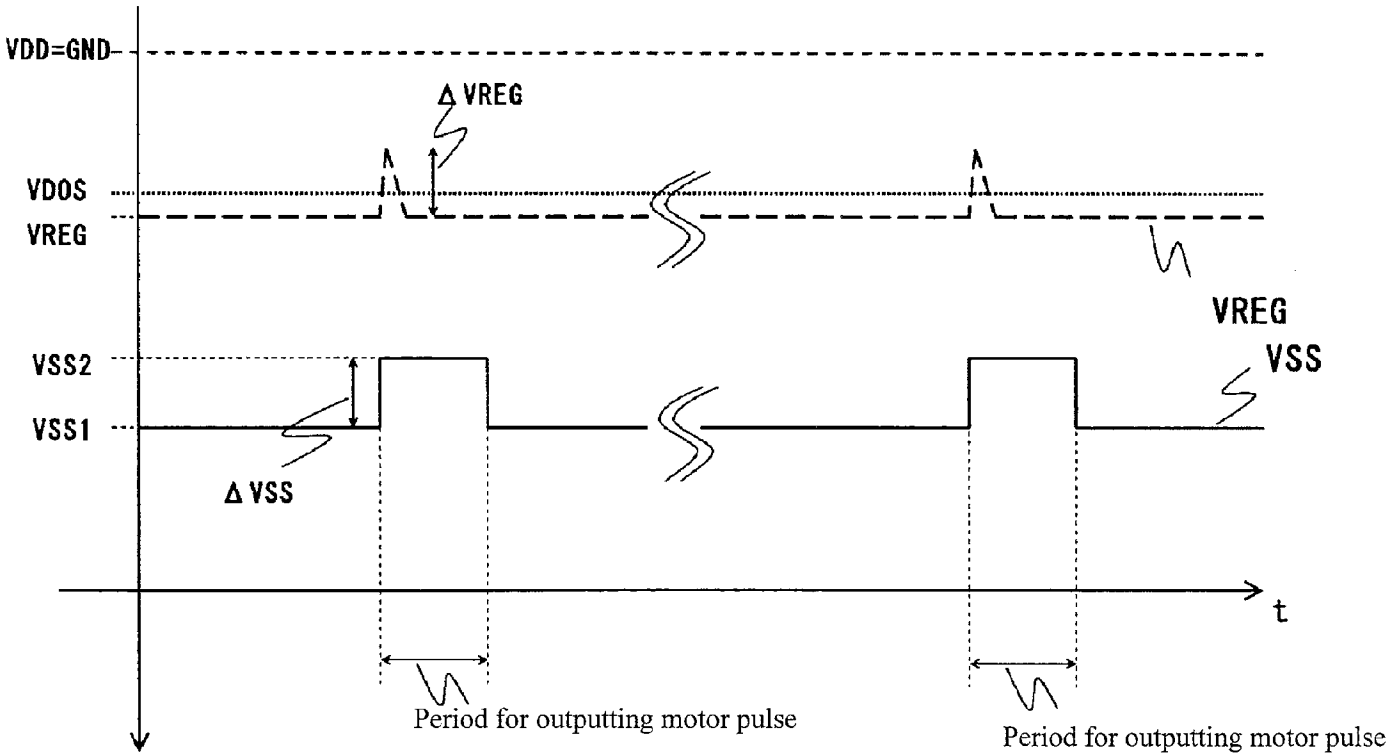
FIG. 7 PRIOR ART
FIG. 7 is an operation explanatory diagram of the analog electronic watch circuit according to the conventional invention.
Figure 8:
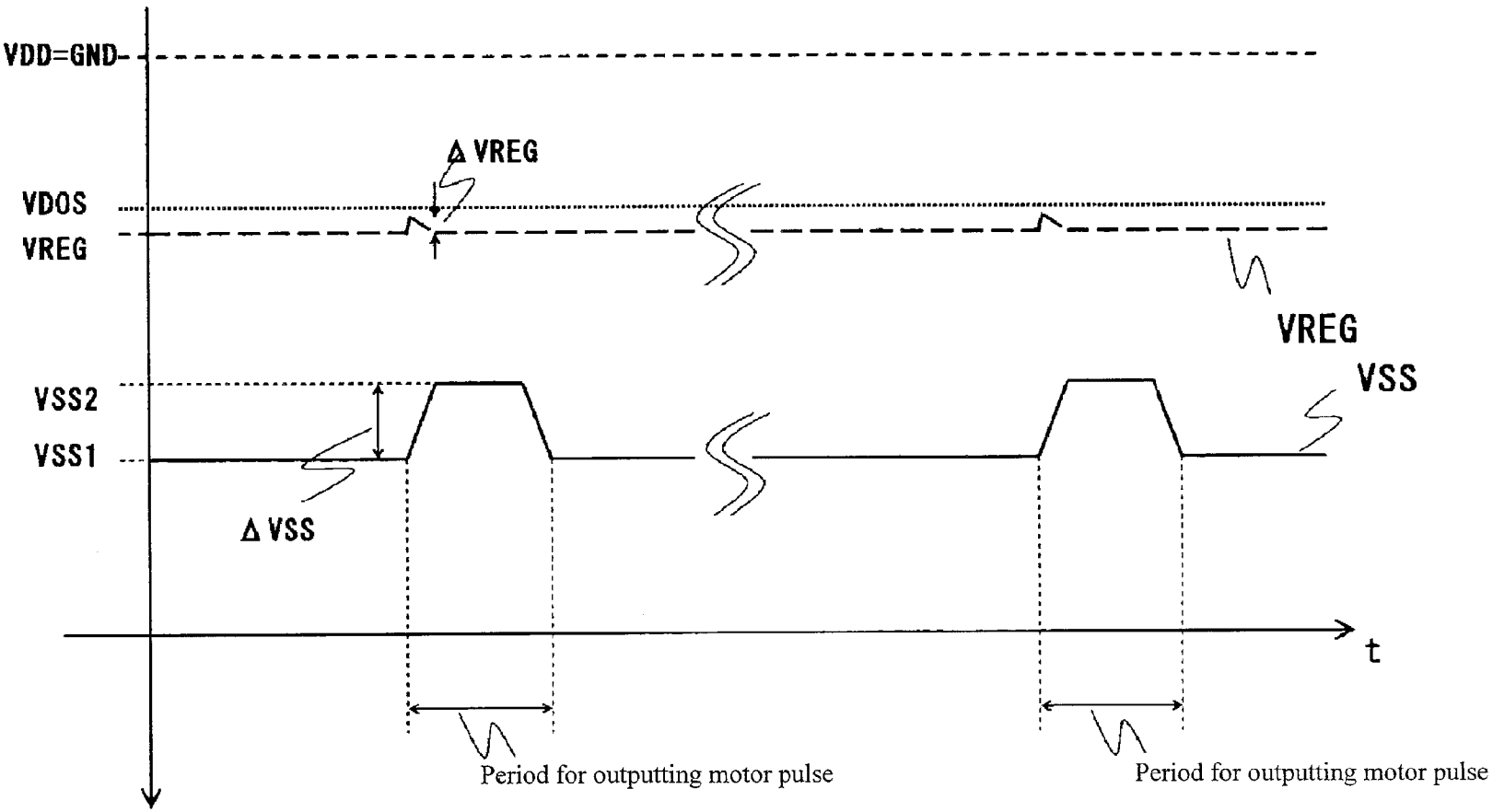
FIG. 8 PRIOR ART
FIG. 8 is an operation explanatory diagram of the analog electronic watch circuit according to the conventional invention.

FIG. 5 illustrates another configuration example of the constant voltage circuit 110 according to this embodiment. The control signal $\phi 1X$ is an inverted signal of the control signal $\phi 1$. When the control signal $\phi 1$ is Low level, a switch formed of transistors N55 and P56 is turned ON, and a transistor P57 is turned OFF. VREG becomes VREG1 which is determined by the sum of a gate-source voltage of a transistor P51 and a gate-source voltage of a transistor N53.

On the other hand, when the control signal $\phi 1$ is High level, the switch formed of the transistors N55 and P56 is turned OFF, and the transistor P57 is turned ON. Then, a transistor N54 is fully turned ON, and hence VREG2 becomes VSS.

What is claimed is:

1. An analog electronic watch, comprising:

a crystal oscillator;

an oscillator circuit;

a frequency divider circuit;

a constant voltage circuit directly coupled to the oscillator circuit and the frequency divider circuit;

a motor;

an output control circuit for outputting a motor drive pulse; and a cell, wherein the constant voltage circuit and the output control circuit are powered from the cell, wherein the oscillator circuit and the frequency divider circuit are supplied with a constant voltage generated by the constant voltage circuit as power, wherein the constant voltage is switchable between a first constant voltage and a second constant voltage, wherein the first constant voltage is a voltage which is smaller in absolute value than a cell voltage, wherein the second constant voltage is a voltage which is larger in absolute value than the first constant voltage and equal to or lower than the cell voltage, wherein the constant voltage is switched to the first constant voltage in a case of normal oscillation, and wherein the constant voltage is switched to the second constant voltage in a case where the motor drive pulse is output.

2. An analog electronic watch according to claim 1, wherein the constant voltage is switched from the first constant voltage to the second constant voltage before a time at which the output of the motor drive pulse is started.

3. An analog electronic watch according to claim 2, wherein the constant voltage is switched from the second constant voltage to the first constant voltage after a time at which the output of the motor drive pulse is finished.

4. An analog electronic watch according to claim 1, wherein the constant voltage is switched from the second constant voltage to the first constant voltage after a time at which the output of the motor drive pulse is finished.

* * * * *